US005102563A

United States Patent [19]

Desbiendras et al.

[11] Patent Number: 5,102,563

[45] Date of Patent: Apr. 7, 1992

[54] CLEANING COMPOSITION BASED ON 1,1,1,2,2-PENTAFLUORO-3,3-DICHLORO-PROPANE AND METHYL TERT-BUTYL ETHER

[75] Inventors: Daniel Desbiendras, Villetaneuse; Jean-Jacques Martin, Bois-Colombes; Pascal Michaud, Saint-Gratien, all of France

[73] Assignee: Societe ATOCHEM, Paris, France

[21] Appl. No.: 698,021

[22] Filed: May 10, 1991

[30] Foreign Application Priority Data

May 10, 1990 [FR] France ..... 90 05807

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 252/153; 252/162; 252/170; 252/364; 252/DIG. 9

[58] Field of Search ..... 252/153, 162, 170, 171, 252/364, DIG. 9; 134/12, 31, 38, 39, 40

[56] References Cited

U.S. PATENT DOCUMENTS 3,804,769 4/1974 Lomas ..... 252/171
4,947,881 8/1990 Magid et al. ..... 134/40
4,961,869 10/1990 Eggers et al. ..... 252/170
4,970,013 11/1990 Merchant ..... 252/162

FOREIGN PATENT DOCUMENTS 258079 3/1988 European Pat. Off. .
347924 12/1989 European Pat. Off. .
2128555 10/1972 France .
2202998 8/1990 Japan .
2204468 8/1990 Japan .
90/08814 8/1990 World Int. Prop. O. .
90/08815 8/1990 World Int. Prop. O. .
91/05035 4/1991 World Int. Prop. O. .

*Primary Examiner*—A. Lionel Clingman
*Assistant Examiner*—Linda D. Skaling
*Attorney, Agent, or Firm*—Morgan & Finnegan

[57] ABSTRACT

For replacing cleaning compositions based on 1,1,2-trichloro-1,2,2-trifluoroethane (F113), the invention provides a composition comprising 55 to 80% by weight of 1,1,1,2,2-pentalfuoro-3,3-dichloropropane (225ca) and 20 to 45% by weight of methyl tert-butyl ether.

These two compounds form a negative azeotrope (b.p. = 59.9° C. at atmospheric pressure).

The composition, which may be stabilized, can be used for cleaning solid surfaces, in particular for removing flux from printed circuits and for degreasing mechanical parts.

7 Claims, No Drawings

CLEANING COMPOSITION BASED ON 1,1,1,2,2-PENTAFLUORO-3,3-DICHLOROPROPANE AND METHYL TERT-BUTYL ETHER

FIELD OF THE INVENTION

The present invention relates to the area of chlorofluorinated hydrocarbons and more particularly to a novel composition exhibiting an azeotrope which can be used as a cleaning and degreasing agent for solid surfaces, in particular for removing flux and low-temperature cleaning of printed circuits.

BACKGROUND OF THE INVENTION 1,1,2-Trichloro-1,2,2-trifluoroethane (known in the art under the name F113) is widely used in industry for cleaning and degreasing solid surfaces. Apart from its application in electronics for cleaning soldering fluxes so as to remove any flux still adhering to the printed circuits, its application in degreasing heavy metal parts and for cleaning high-quality, high-precision mechanical parts, such as, for example, gyroscopes and military or aerospace equipment may be mentioned. In its various applications, F113 is most often combined with other organic solvents (for example methanol), preferably in the form of azeotropic or pseudoazeotropic mixtures which do not separate and when being refluxed have essentially the same composition in the vapor phase as in the liquid phase.

However, F113 is one of the completely halogenated chlorofluorocarbons which are currently suspected of attacking and decomposing stratospheric ozone.

DESCRIPTION OF THE INVENTION

As a contribution to solving this problem, the present invention proposes to replace the compositions based on F113 by a novel composition based on methyl tert-butyl ether (thereafter MTBE) and 1,1,1,2,2-pentafluoro-3,3-dichloropropane. The latter compound, known in the art under the name 225ca, is virtually devoid of any destructive effect with respect to ozone.

The composition to be used according to the invention comprises 55 to 80% by weight of 225ca and 20 to 45% of MTBE. This range gives rise to an azeotrope whose boiling temperature is 59.9° C. at standard atmospheric pressure (1.013 bar), while the composition according to the invention has pseudoazeotropic behavior, i.e., the composition of the vapor phase and liquid phase is essentially the same, which is particularly advantageous for the intended applications. Preferably, the 225ca content is chose from between 62 and 67% by weight and that of MTBE from between 38 and 33% by weight.

The 225ca/MTBE azeotrope is a negative azeotrope, because its boiling point (59.9° C.) is above that of the constituents (225ca:51.1° C.; MTBE:54° C.).

Similar to the known compositions based on F113, the composition according to the invention can be advantageously stabilized against hydrolysis and/or attack by free radicals, which are likely to occur during the cleaning process, by adding a conventional stabilizer, such as, for example, nitromethane, propylene oxide or a mixture of these compounds, the proportion of the stabilizer ranging from 0.01 to 5%, relative to the total weight of 225ca +MTBE.

The composition according to the invention can be used for the same applications and using the same techniques as the former compositions based on F113.

EXAMPLES

The examples which follow illustrate the invention without limiting it.

EXAMPLE 1 : DETECTION OF THE AZEOTROPE 100 g of MTBE and 100 g of 225ca are introduced in the bottom of a distillation column (30 plates). The mixture is then refluxed for one hour to bring the system to equilibrium. After reaching a steady temperature (59.9° C.), a fraction (about 50 g) is removed and analyzed by gas-phase chromatography.

The test results shown in the table below indicate the presence of a 225ca/MTBE azeotrope.

| | COMPOSITION (% by weight) | |
|---|---|---|
| | 225ca | MTBE |
| Initial mixture | 50 | 50 |
| Fraction removed | 64.5 | 35.5 |

EXAMPLE 2: VERIFICATION OF THE AZEOTROPIC COMPOSITION 200 g of a mixture comprising 64.5% by weight of 225ca and 5.5% by weight of MTBE are introduced into the boiler of an adiabatic distillation column (30 plates). The mixture is then refluxed for one hour to bring the system to equilibrium, and a fraction of about 50 g is then removed and it is then analyzed by gas-phase chromatography. The results listed in the table below show the presence of a negative azeotrope, because its boiling point is above that of the pure constituents: 225ca and MTBE.

| | COMPOSITION (% by weight) | |
|---|---|---|
| | 225ca | MTBE |
| Initial mixture | 64.5 | 35.5 |
| Fraction collected | 64.5 | 35.5 |
| Still bottom | 64.4 | 35.6 |

Boiling temperature corrected for 1.013 bar: 59.9° C.

When employed for cleaning soldering flux or degreasing mechanical parts, this azeotrope gives results which are as good as those of the compositions based on F113 and methanol.

EXAMPLE 3: CLEANING-OFF OF SOLDERING FLUX 200 g of the azeotropic 225ca/MTBE composition are introduced into an Annemasse ultrasonic bath, and the mixture is then brought to the boiling temperature.

Glass plates which are coated with soldering flux and have been heated in an oven at 220° C for 30 seconds are immersed in the boiling ultrasonic liquid for 3 minutes and then rinsed in the vapor phase for 3 minutes.

After drying in air, inspection using low-angle illumination reveals a complete absence of any residual soldering flux. Thus, the same result was obtained as when using an F113/methanol (93.7%/6.3%) composition.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. Azeotropic cleaning composition consisting essentially of 55 to 80% by weight of 1,1,1,2,2-pentafluoro-3,3-dichloro-propane and 45 to 20% by weight of methyl tert-butyl ether wherein said composition boils at 59.9° C. at atmospheric pressure.

2. Composition according to claim 1, wherein the composition contains 62 to 67% by weight of 1,1,1,2,2-pentafluoro-3,3-dichloro-propane and 38 to 33% by weight of methyl tert-butyl ether.

3. Composition according to claim 1, further comprising at least one stabilizer.

4. Composition according to claim 3, wherein the stabilizer is nitromethane, propylene oxide, or a mixture of these compounds.

5. Composition according to claim 3, wherein the proportion of stabilizer is 0.01 to 5%, relative to the total weight of the mixture: 1,1,1,2,2-pentafluoro-3,3-dichloropropane and methyl tert-butyl ether.

6. Method of cleaning of solid surface comprising contacting said surface with an effective amount of an azeotropic composition according to claim 1.

7. Method according to claim 6 wherein said surface is a printed circuit or a mechanical part.

* * * * *